United States Patent [19]

Dovell et al.

[11] 3,961,389

[45] June 8, 1976

[54] DEPTH REGULATING APPARATUS

[75] Inventors: Clark W. Dovell, Potomac; Frank Peregrim, Silver Spring; Daniel R. Tolliver, Laurel, all of Md.

[73] Assignee: The United States of America as represented by the Secretary of the Navy, Washington, D.C.

[22] Filed: Sept. 9, 1969

[21] Appl. No.: 856,414

[52] U.S. Cl. ..... 9/8 R

[51] Int. Cl.[2] ..... B63B 21/52

[58] Field of Search ..... 9/8, 8 R; 102/14, 14 X, 102/13; 114/206 R

[56] References Cited

UNITED STATES PATENTS 3,471,877 10/1969 Bayles ..... 9/8 R 3,631,550 1/1972 Bullen ..... 9/8 R

*Primary Examiner*—Trygve M. Blix

*Assistant Examiner*—Gregory W. O'Connor

[57] ABSTRACT

Apparatus for automatically controlling the mooring depth of a submerged buoyant body secured to an anchor by a mooring line contained within the anchor having a power supply, a first potentiometer preset to a desired mooring depth and variable with the payout of mooring line, a second potentiometer variable with ambient water pressure for sensing the depth of the anchor, and a null detector connected between the slidable taps of the potentiometers and a mooring line payout control system for actuating the payout control system if there is an unbalance therebetween in one, but only one, direction.

4 Claims, 3 Drawing Figures

FIG. 1
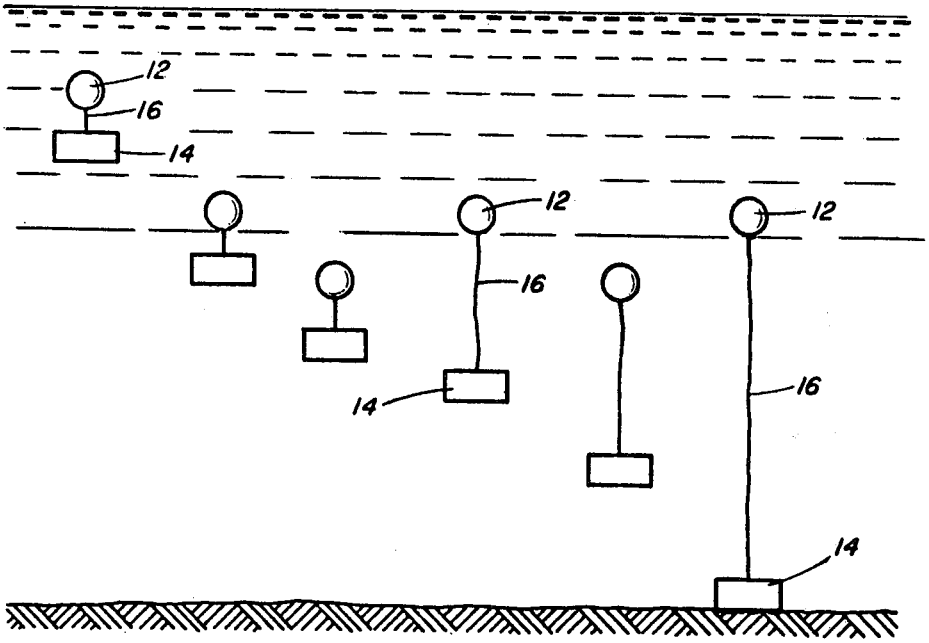
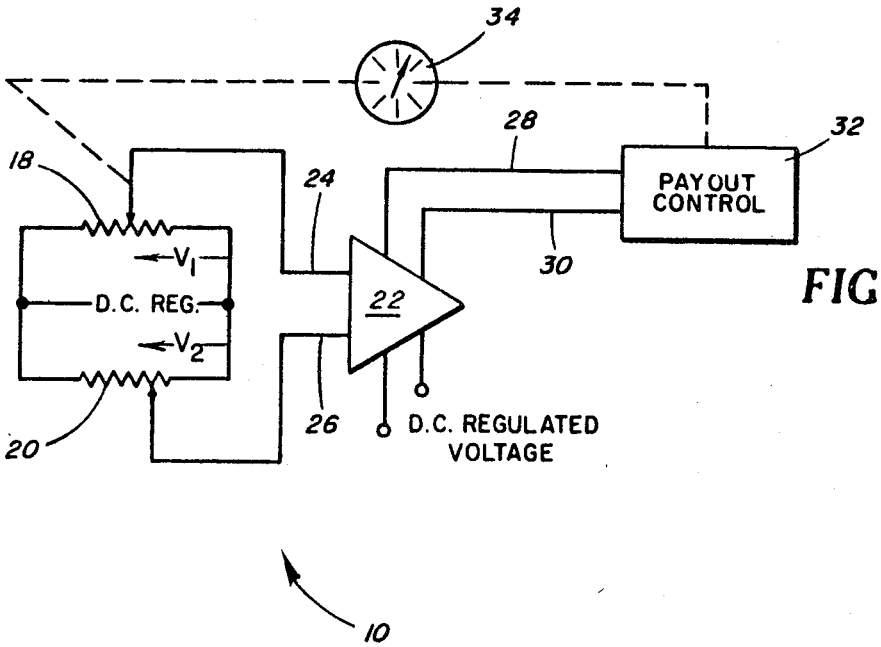
FIG. 2

DEPTH REGULATING APPARATUS

BACKGROUND OF THE INVENTION

This invention relates generally to submerged mooring devices and more particularly to a depth regulating apparatus for automatically controlling the mooring depth of a submerged buoyant body secured to an anchor by an extensible mooring line or cable.

Numerous arrangements have heretofore been provided for anchoring buoys, mine cases and the like at predetermined distances below the surface of the water with various means for adjusting the depth below the surface, including commonly used plummet devices, hydrostatic-loose bight combinations, and other electromechanical devices. Although these previous arrangements have been generally successful, they have not been found to be entirely satisfactory in all cases. In use, for example, these arrangements have been restricted to relatively shallow water depths and in most instances they have been embodied in heavy and bulky mechanisms substantially unfit or ill-suited for use where severe weight and space restrictions are imposed.

SUMMARY OF THE INVENTION

Accordingly, it is an object of the present invention to provide an improved depth control apparatus for automatically controlling the mooring depth of a submerged body.

Another object of the present invention is to provide a lightweight depth control apparatus for automatically controlling the mooring depth of a body submerged in deep water.

Still another object of the present invention is to provide an apparatus for automatically controlling the depth of a buoyant body connected to an anchor by a mooring line stored within the anchor by regulating the payout of the mooring line after the body has sunk to a predetermined depth.

A further object of this invention is to provide a lowcost, compact and lightweight depth control apparatus disposable in an anchor for automatically controlling the depth of a submerged body by regulating the payout from the anchor of a mooring line connected to the submerged body only after the body and the anchor have sunk to a predetermined mooring depth.

According to one preferred embodiment of the present invention the foregoing and other objects, advantages and features are attained by an electromechanical system having a power supply, a first potentiometer preset to a desired mooring depth and variable with the mooring line payout, a second potentiometer variable with the ambient pressure for sensing continuously the depth of the anchor, and a null detector connected between the slidable taps of the potentiometers and a mooring line payout control system for actuating the payout control system if there is an unbalance therebetween in one, but only one, direction. Thus, under the automatic control of this apparatus, which may be contained exclusively within the anchor, a submerged body is moored at a predetermined depth while the anchor sinks to the ocean bottom. Since no equipment need be carried by the buoyant body, according to the present invention, more space and weight are available therein for essential electronic equipment or an ordnance payload.

BRIEF DESCRIPTION OF THE DRAWINGS

Still other objects and many of the attendant advantages of this invention will be readily appreciated as the same becomes better understood by reference to the following detailed description when considered in connection with the accompanying drawing wherein like reference numerals designate like or corresponding parts throughout the several views and in which:

FIG. 1 is a diagrammatical view showing the sequence of operations of the buoyant body and the anchor during the mooring of the body at a predetermined depth;

FIG. 2 is a schematic view of the control system for the apparatus illustrated in FIG. 1; and, FIG. 3 is a schematic view of an electrical control circuit formed according to the teachings of the present invention for carrying out the sequence of operations shown in FIG. 1.

DESCRIPTION OF AN ILLUSTRATED EMBODIMENT

Figure 3:
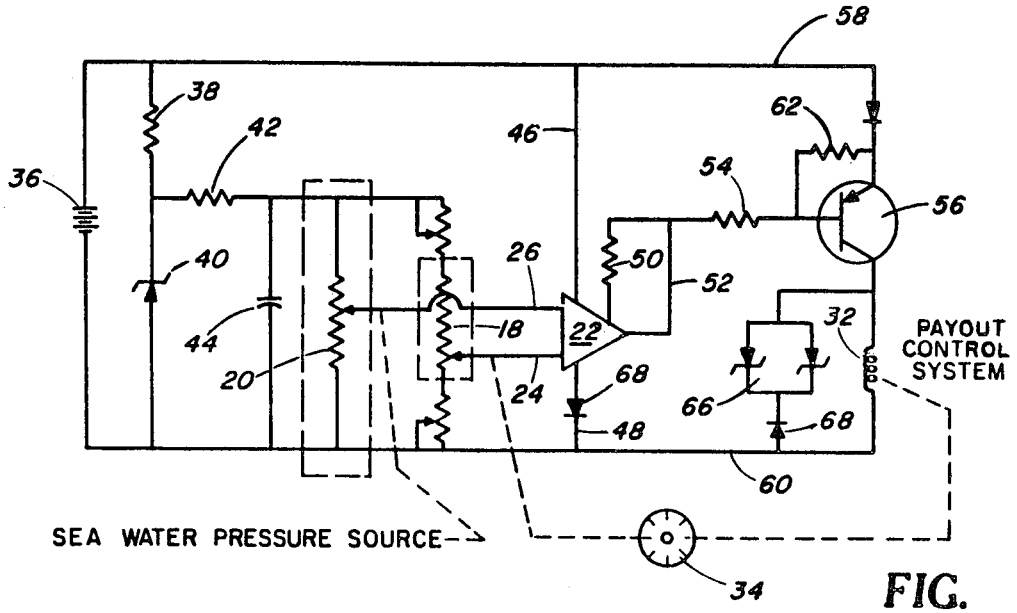

Referring now to the drawings, there is shown a depth controller generally indicated by the reference numeral 10 for mooring a buoyant body 12 at a preselected depth and which functions basically as a null detector across a Wheatstone Bridge, the simplest version of which is shown in FIG. 2 and consists of three major components. These components are disposed within an anchor 14 connected by a mooring line 16 to the buoyant body 12 and include a cable payout and depth setting potentiometer 18 constituting one leg of the bridge and being manually settable for a predetermined mooring depth and connected to an anchor payout control system in such a manner that turns of the potentionmeter are proportional to the amount of mooring line 16 payed out from the anchor 14, a depth measuring potentiometer 20 constituting the other leg of the bridge and being hydraulically connected to a conventional ambient seawater pressure sensing device for continuously measuring the depth of the anchor, and an amplifier null detector 22 having its input terminals 24 and 26 connected to the respective slide arms of the cable payout and depth setting potentiometer 18 and the depth measuring potentiometer 20 and having its output terminals 28 and 30 connected to the mooring line payout control system 32 so as to be responsive to unbalance in the bridge in one direction only for actuating the payout control system to pay out the mooring line from the anchor. Thus, the circuit component values and mechanical ratios are selected such that the bridge is in balance when the buoyant body 12 and the anchor 14 are at the preselected desired mooring depth or whenever the amount of mooring line 16 payed out from the anchor 14 is equal to the increase in depth between the anchor 14 and the preselected desired mooring depth, whereby the buoyant body 12 is at the preselected desired mooring depth.

A d.c. reference voltage is applied across the legs of the bridge and, in accordance with the well-known principle of such bridges, if the anchor and the buoyant body are not at the preselected mooring depth wherein the bridge is in balance or a length of mooring line equivalent to the increase in depth of the anchor from the preselected mooring depth has not been payed out therefrom, an error signal is generated between the balance points formed by the slide arms of the potentiometers 18 and 20. The polarity of the error signal relative to the reference voltage is therefore generally dependent upon whether the buoyant body 12 attached to the anchor 14 by the mooring line 16 is above or below the preselected desired mooring depth and the magnitude of the error signal is determined by the difference between the actual depth and the preselected depth. Any error voltage is fed to the amplifier null detector 22 which contains conventional detection circuitry for determining the polarity of the error signal relative to the reference signal, and is so connected that it is responsive only to an unbalance in one direction, namely the unbalance that is created when the buoyant body 12 is below the preselected mooring depth and an insufficient amount of mooring cable 16 has been released from the anchor 14 to permit the buoyant body 12 to rise to the desired mooring depth. Thus, whenever the bias goes through "zero", or changes polarity, in the aforementioned one direction, the amplifier null detector 22 becomes conductive, or is switched "on", to actuate the cable payout control system 32.

In operation, therefore, the desired mooring depth is preset into the controller 10 by turning a turns-counting dial 34, which is connected between the payout control system 32 and the payout and depth setting potentiometer 18 and mechanically driven by the payout system, to the proper setting representing the desired depth in feet at which the buoy 12 is to be moored. This changes the setting of the payout and depth setting potentiometer 18 so that when operation of the anchoring system is initiated, an unbalance $V_1 > V_2$ is present in the null detector 22. This unbalance is in such a direction as indicated hereinabove that the payout control system 32 remains inactive and no mooring cable 16 is payed out from the anchor 14.

When the anchor 14 and the buoyant body 12 attached thereto are launched, they sink until the depth sensing potentiometer 20 detects that the preselected mooring depth set into dial 34 has been reached. At this point $V_1 = V_2$ and the null detector 22 is balanced. After the desired mooring depth is reached, the anchor 14 and the buoyant body 12 continue to sink, and the slide arm of the potentiometer 20, being continuously responsive to the actual depth of the anchor 14 in which it is contained, moves to cause $V_1$ to become less than $V_2$, whereby the null detector 22, acting like an electronic switch, becomes unbalanced in the direction causing it to switch "on" and thereby actuate the payout control system 32 for paying out mooring cable 16 from the anchor. The operation of the depth controller 10 now becomes a series of balance and unbalance sequences, as illustrated in FIG. 1, whereby anchor depth increase is equalled by mooring line payout in successive steps, keeping the submerged buoyant body 12 substantially stationary at the predetermined desired mooring depth until the anchor 14 sinks to the ocean floor.

Referring now more particularly to FIG. 3, there is shown a complete electrical depth control circuit 10 embodying the principles of the present invention. The circuit includes a d.c. reference voltage 36, a current limiting resistor 38 and a Zener diode 40 for regulating the voltage through a resistor 42 and the bridge potentiometers 18 and 20 forming another circuit path connected thereacross. Voltage surges in this latter path are eliminated by a condenser 44 connected across the power supply connection thereto. The slide arms of the potentiometers 18 and 20 are connected to input lines 24 and 26 of the null detector 22, wherein $V_1$ is compared with $V_2$. A regulated voltage is connected to null detector 22 from the positive terminal of supply 36 through line 46 and back to the negative terminal through line 48 for determining the phase polarity of the error signal relative to the regulated signal. Upon detecting a change of polarity or an unbalance in the one direction only, the null detector 22, having a biasing resistor 50 connected therewith across an output line 52, is switched "on" in the manner hereinabove indicated and a control signal is produced, passing through line 52 and a current limiting resistor 54 therein to the base of a PNP transistor 56. Power is supplied from the positive side of the battery 36 through a line 58 to the emitter of the transistor 56 and, from the collector thereof, is returned through line 60 to the negative side of the battery. A biasing resistor 62 is provided across the base and emitter circuits of the transistor 56 and the load or payout control system 32 is connected in the collector circuit. Thus, the transistor 56 is triggered or switched to a conductive state by the null detector 22 to operate the anchor payout system 32 for paying out additional mooring cable 16 for the buoyant body 12. A network of Zener diodes 66 and rectifier diodes 68 is provided between the payout control system 64 and the null detector 22 and transistor 56 for preventing the surge of back electromotive force whenever the payout control system is switched "off".

It may be seen that the depth controller described herein is a compact and lightweight device utilizing solid state components throughout. Accordingly, cost is substantially reduced over previous arrangements and a generous saving of space is realized. Accuracy of the device has been found to be excellent and the power requirements are low. The operating depth of the device is limited only by the pressure capabilities of the anchor housing and the length of the mooring line stored in the anchor. Except for the manual depth setting of the preselected mooring depth, the entire operation of the depth controller of the present invention is automatic.

Obviously many modifications and variations of the present invention are possible in light of the above teachings. It is therefore to be understood that within the scope of the appended claims the invention may be practiced otherwise than as specifically claimed.

What is claimed is:

1. Apparatus for mooring a buoyant body at a preselected depth in a body of water comprising:

an anchor;

a mooring line connecting said buoyant body and said anchor and substantially contained within said anchor;

pressure sensing means within said anchor for measuring continuously the depth of said anchor;

means within said anchor for measuring the amount of said mooring line payed out from said anchor; and, payout control means in said anchor responsive to said pressure sensing means and said mooring line measuring means for regulating the payout of mooring line to float the submerged buoyant body at said preselected depth.

2. Apparatus set forth in claim 1 wherein:

said pressure sensing means comprises a potentiometer having a slide arm movably responsive to the ambient water pressure in said body of water; and, said mooring line measuring means comprises a potentiometer the turns of which are proportional to the amount of mooring line payed out from said anchor and having a slide arm connected mechanically with said payout control means and movably responsive to said payout of said mooring line.

3. Apparatus set forth in claim 2 further including means for manually presetting the slide arm of said mooring line measuring potentiometer to a position thereon representative of said preselected mooring depth.

4. Apparatus set forth in claim 3 wherein:

said payout control means comprises a null detector means connected to said pressure sensing potentiometer and said mooring line measuring potentiometer for comparing the signals thereof and responsive to an unbalance in such signals in one direction only for paying out said mooring line from said anchor, whereby said buoyant body and said anchor sink together to said preselected mooring depth and said buoyant body thereafter remains substantially stationary at said preselected mooring depth while said anchor sinks to the bottom of said body of water.

* * * * *